US010143613B2

(12) United States Patent
Endo

(10) Patent No.: US 10,143,613 B2
(45) Date of Patent: Dec. 4, 2018

(54) STEP COUNTER, STEP ASSIST DEVICE, AND COMPUTER-READABLE MEDIUM HAVING STORED THEREON A STEP COUNT PROGRAM

(71) Applicant: HONDA MOTOR CO., LTD., Minato-Ku, Tokyo (JP)

(72) Inventor: Yosuke Endo, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 650 days.

(21) Appl. No.: 14/739,015

(22) Filed: Jun. 15, 2015

(65) Prior Publication Data

US 2015/0366739 A1 Dec. 24, 2015

(30) Foreign Application Priority Data

Jun. 19, 2014 (JP) ..... 2014-126168

(51) Int. Cl.
*A61H 3/00* (2006.01)
*A61H 1/02* (2006.01)

(52) U.S. Cl.
CPC ..... *A61H 3/00* (2013.01); *A61H 1/0244* (2013.01); *A61H 2201/1215* (2013.01); *A61H 2201/163* (2013.01); *A61H 2201/165* (2013.01); *A61H 2201/1642* (2013.01); *A61H 2201/5069* (2013.01)

(58) Field of Classification Search
CPC .... A61H 2201/5069; A61H 2201/1215; A61H 1/0244; A61H 3/00; A61H 2003/007
See application file for complete search history.

(56) References Cited

U.S. PATENT DOCUMENTS

| | | | | |
|---|---|---|---|---|
| 9,619,698 | B1 * | 4/2017 | Chuang | G06K 9/00342 |
| 9,682,006 | B2 * | 6/2017 | Goldfarb | A61H 3/00 |
| 2006/0195050 | A1 * | 8/2006 | Alwan | A61B 5/1038 600/595 |
| 2010/0010639 | A1 * | 1/2010 | Ikeuchi | A61H 3/008 623/24 |
| 2011/0288453 | A1 * | 11/2011 | Endo | A61H 1/0244 601/35 |
| 2013/0138020 | A1 * | 5/2013 | Yasuhara | A61H 3/00 601/35 |

(Continued)

FOREIGN PATENT DOCUMENTS

| | | |
|---|---|---|
| JP | 2010071779 A | 4/2010 |
| JP | 2012205826 A | 10/2012 |

*Primary Examiner* — Mohamed Charioui
*Assistant Examiner* — Catherine Rastovski

(57) ABSTRACT

Provided is a step counter including a right angle sensor that outputs a right hip joint angle signal indicating a right hip joint angle of a user; a left angle sensor that outputs a left hip joint angle signal indicating a left hip joint angle of the user; a generating section that generates an angle difference signal indicating change over time of an angle difference between the right hip joint angle and the left hip joint angle, based on the right hip joint angle signal and the left hip joint angle signal; and a calculating section that calculates a step number of the user based on a difference signal generated from a difference between filtered signals resulting from the angle difference signal being applied to at least two different filters.

13 Claims, 10 Drawing Sheets

(56) References Cited

U.S. PATENT DOCUMENTS

2015/0088269 A1* 3/2015 Roh ..... A61F 2/72
623/25
2016/0107309 A1* 4/2016 Walsh ..... B25J 9/0006
248/550

* cited by examiner $\theta_R$ $\theta_L$ $\theta_S (= \theta_R - \theta_L)$ $\theta_{S1}$ $\theta_{S2}$ $\theta_M (= \theta_{S1} - \theta_{S2})$ NORMAL STEPS: $\theta_M$ DRAGGING STEPS: $\theta_M$ DRAGGING STEPS: $\theta_{S2}$ SLOW STEPS: $\theta_M$

STEP COUNTER, STEP ASSIST DEVICE, AND COMPUTER-READABLE MEDIUM HAVING STORED THEREON A STEP COUNT PROGRAM

The content of the following Japanese application is incorporated herein by reference:

NO. 2014-126168 filed on Jun. 19, 2014.

BACKGROUND

1. Technical Field

The present invention relates to a step counter, a step assist device and a step control program.

2. Related Art

A step counter is known that has an acceleration sensor mounted thereon, as shown in Patent Document 1, for example. A step assist device is known that can count the number of steps, as shown in Patent Document 2, for example.

Patent Document 1: Japanese Patent Application Publication No. 2010-71779

Patent Document 2: Japanese Patent Application Publication No. 2012-205826

A step counter that uses an acceleration sensor or a step counter that detects contact between the sole of a foot and the ground can relatively easily count the number of steps for a healthy user, but if the user walks in an irregular manner, these step counters cannot accurately count the number of steps. For example, it is difficult to accurately count the number of steps for a rehabilitation patient who is receiving walking assistance from a step assist device.

SUMMARY

According to a first aspect of the present invention, provided is a step counter comprising a right angle sensor that outputs a right hip joint angle signal indicating a right hip joint angle of a user; a left angle sensor that outputs a left hip joint angle signal indicating a left hip joint angle of the user; a generating section that generates an angle difference signal indicating change over time of an angle difference between the right hip joint angle and the left hip joint angle, based on the right hip joint angle signal and the left hip joint angle signal; and a calculating section that calculates a step number of the user based on a difference signal generated from a difference between filtered signals resulting from the angle difference signal being applied to at least two different filters.

According to a second aspect of the present invention, provided is a step assist device comprising a providing section that provides auxiliary force to a step movement of a user and the step counter described above.

According to a third aspect of the present invention, provided is a computer-readable medium storing thereon a step count program that, when executed by a computer, causes the computer to generate an angle difference signal indicating change over time of an angle difference between a right hip joint angle and a left hip joint angle, based on a right hip joint angle signal indicating the right hip joint angle of a user and output by a right angle sensor and a left hip joint angle signal indicating the left hip joint angle of the user and output by a left angle sensor; and calculate a step number of the user based on a difference signal generated from a difference between filtered signals resulting from the angle difference signal being applied to at least two different filters.

The summary clause does not necessarily describe all necessary features of the embodiments of the present invention. The present invention may also be a sub-combination of the features described above.

DESCRIPTION OF EXEMPLARY EMBODIMENTS

Hereinafter, some embodiments of the present invention will be described. The embodiments do not limit the invention according to the claims, and all the combinations of the features described in the embodiments are not necessarily essential to means provided by aspects of the invention.

Figure 1:
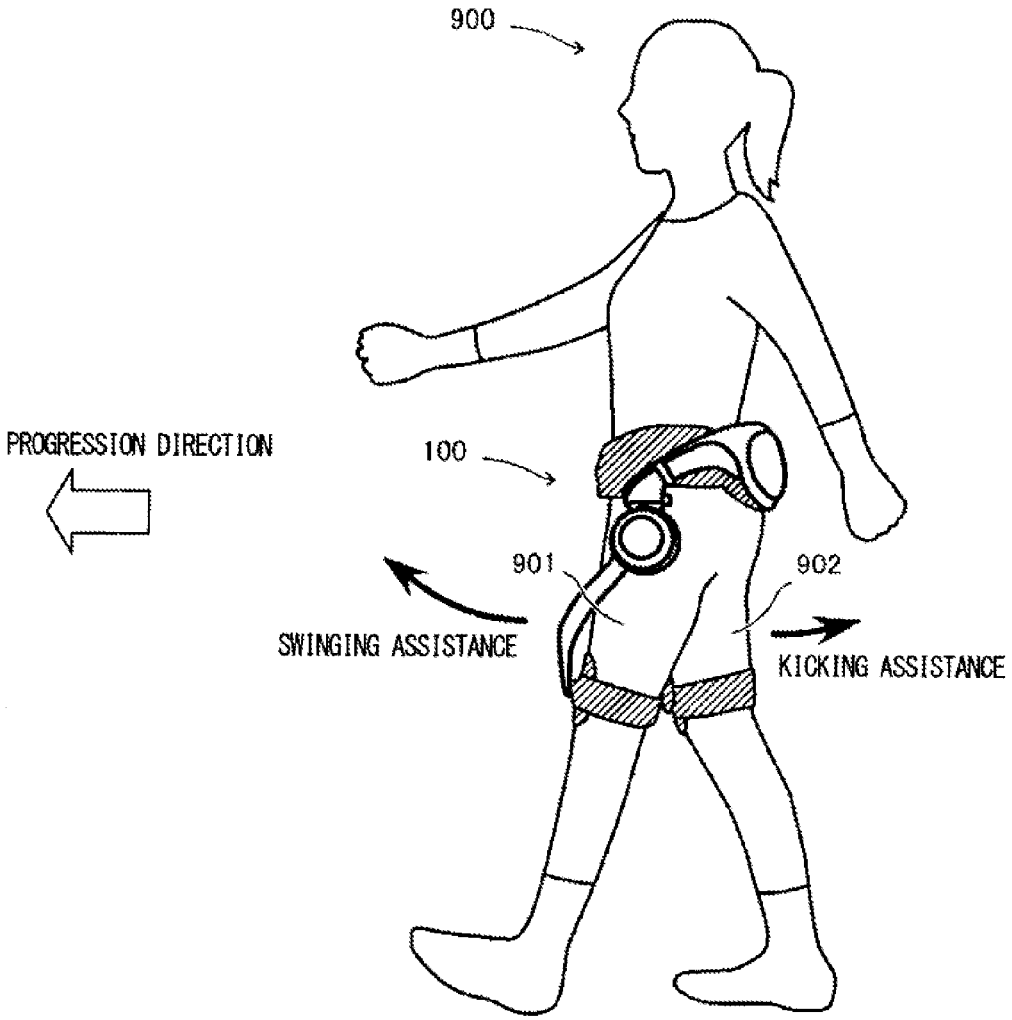
FIG. 1 is a view for describing a usage state of a step assist device according to the present embodiment.

FIG. 1 is a view for describing a usage state of a step assist device 100 according to the present embodiment. A user 900 attaches and secures the step assist device 100 to the waist and leg regions. The step movement of a person generally includes alternating repetition of a movement of kicking out the pivot leg and a movement of swinging forward the other leg. For example, as shown in the drawing, when the right leg is the pivot leg and the left leg is swung, the step assist device 100 assists with the kicking by applying a backward auxiliary force to the right thigh 902 and assists with the swinging by applying a forward auxiliary force to the left thigh 901. On the other hand, when the left leg is the pivot leg and the right leg is swung, the step assist device 100 assists with the kicking by applying a backward auxiliary force to the left thigh 901 and assists with the swinging by applying a forward auxiliary force to the right thigh 902. By repeating the assistance movement, the step assist device 100 can provide an auxiliary force for forward progression, thereby enabling the user 900 to walk comfortably.

The step assist device 100 is not limited to use by an able-bodied person. The step assist device 100 is also used by patients in rehabilitation who are training to recover their normal walking ability. For example, a rehabilitation patient who has suffered partial paralysis as the result of a stroke is prone to stumble when walking, due to a decrease in the knee joint angle during the swing phase, which is the interval during which the leg swings, and this is known to cause gait problems such as pulling up on the pelvis. The step assist device 100 can increase the knee joint angle by providing swing assistance, and is therefore suitable for use in rehabilitation after a stroke. Accordingly, the step assist device 100 can rectify the gait at an early stage and in a manner appropriate for the state of the rehabilitation patient. Furthermore, as another aspect, the step assist device 100 can decrease the physical exertion of a physical therapist who would have, up to this point, been giving rehabilitation treatment by moving while supporting the legs of the rehabilitation patient.

In addition, the step assist device 100 is not limited to being used by people, and can be applied to animals and machines. The step assist device 100 is not limited to providing assistance, and can also operate to provide resistance. In other words, the step assist device 100 can generate a resistance force that applies a backward auxiliary force against the swinging movement and a forward auxiliary force against the kicking movement of the user 900. By operating in this manner, the step assist device 100 can be used as a training device for strength training by an athlete, for example.

The present embodiment describes a case in which the auxiliary force is applied for assistance. The following provides a detailed description of the step assist device 100.

Figure 2:
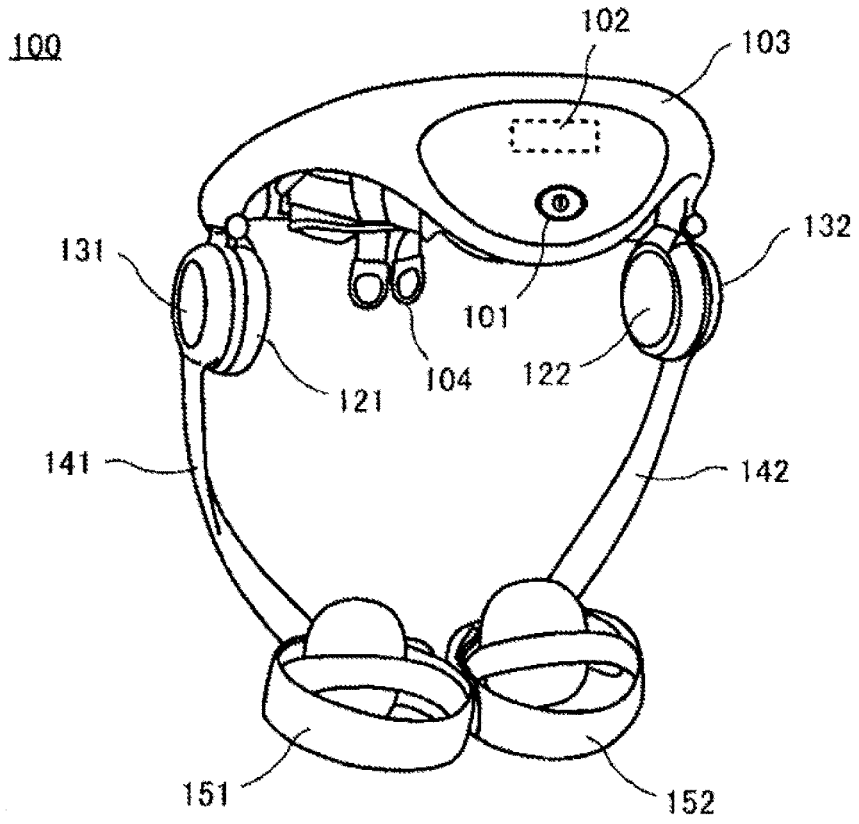
FIG. 2 is an external perspective view of the step assist device.

FIG. 2 is an external perspective view of the step assist device 100. The step assist device 100 includes a waist frame 103 that presses from the back of the waist region toward the sides of the waist region of the user 900. The waist frame 103 is formed from a highly rigid material such as a light-weight alloy of aluminum or the like, resin, e.g. polycarbonate, or carbon fiber. An activation switch 101 is provided near the center of the back surface of the waist frame 103, and the step assist device 100 can be made to operate when the user 900 presses the switch. Furthermore, the step assist device 100 can be made to stop when the switch is pressed once again.

A battery 102, which supplies electrical power to the step assist device 100, is arranged in an attachable and detachable manner on the back surface of the waist frame 103. The battery 102 may be a lithium ion battery with an output voltage of approximately 20 V, for example.

A waist belt 104 is connected to the ends of the waist frame 103. The waist belt 104 is wound around the waist of the user 900 together with the waist frame 103, and is fastened on the stomach surface side. The belt portion of the waist belt 104 is formed by a soft material such as a textile material. In this way, by using the waist frame 103 and the waist belt 104, the step assist device 100 is securely fastened to the user 900.

A left motor 121 and a right motor 122 are arranged on both of the waist side surfaces of the waist frame 103. The left motor 121 and the right motor 122 are motors with the same specifications, and are DC motors having an output capability with a maximum torque of 4 N·m, for example. The left motor 121 rotates a left thigh frame 141 relative to the waist frame 103. The left thigh frame 141 is provided with a left angle sensor 131 that detects the rotational angle of the output rotation axis of the left motor 121. In the same manner, the right motor 122 rotates a right thigh frame 142 relative to the waist frame 103. The right thigh frame 142 is provided with a right angle sensor 132 that detects the rotational angle of the output rotation axis of the right motor 122. The left angle sensor 131 and the right angle sensor 132 are rotary encoders, for example.

The left thigh frame 141 and the right thigh frame 142 are formed from a highly rigid material such as a light-weight alloy of aluminum or the like, resin, e.g. polycarbonate, or carbon fiber, in the same manner as the waist frame 103. A left thigh belt 151 is attached to the left thigh frame 141 on another end thereof that is opposite the one end to which the left motor 121 is connected. The user 900 winds and secures the left thigh belt 151 around the thigh of the left leg near the knee. In the same manner, a right thigh belt 152 is attached to the right thigh frame 142 on another end thereof that is opposite the one end to which the right motor 122 is connected. The user 900 winds and secures the right thigh belt 152 around the thigh of the right leg near the knee. The left thigh belt 151 and the right thigh belt 152 are formed of a soft material, such as a textile material.

With the step assist device 100 configured in this manner, when the left motor 121 is not being powered, the left angle sensor 131 can detect the rotational angle of the left thigh 901 during the step movement of the user 900 by their own strength. When the left motor 121 is powered and rotates forward, the left motor 121 rotates the left thigh frame 141 in the swinging direction, and as a result generates an auxiliary force that lifts the thigh of the left leg forward. When the left motor 121 is powered and rotates backward, the left motor 121 rotates the left thigh frame 141 in the kicking direction, and as a result generates an auxiliary force that presses the thigh of the left leg downward. The left angle sensor 131 also detects the rotational angle of the left thigh 901 when the left motor 121 is being powered.

In the same manner, when the right motor 122 is not being powered, the right angle sensor 132 can detect the rotational angle of the right thigh 902 during the step movement of the user 900 by their own strength. When the right motor 122 is powered and rotates backward, the right motor 122 rotates the right thigh frame 142 in the swinging direction, and as a result generates an auxiliary force that lifts the thigh of the right leg forward. When the right motor 122 is powered and rotates forward, the right motor 122 rotates the right thigh frame 142 in the kicking direction, and as a result generates an auxiliary force that presses the thigh of the right leg downward. The right angle sensor 132 also detects the rotational angle of the right thigh 902 when the right motor 122 is being powered.

Figure 3:
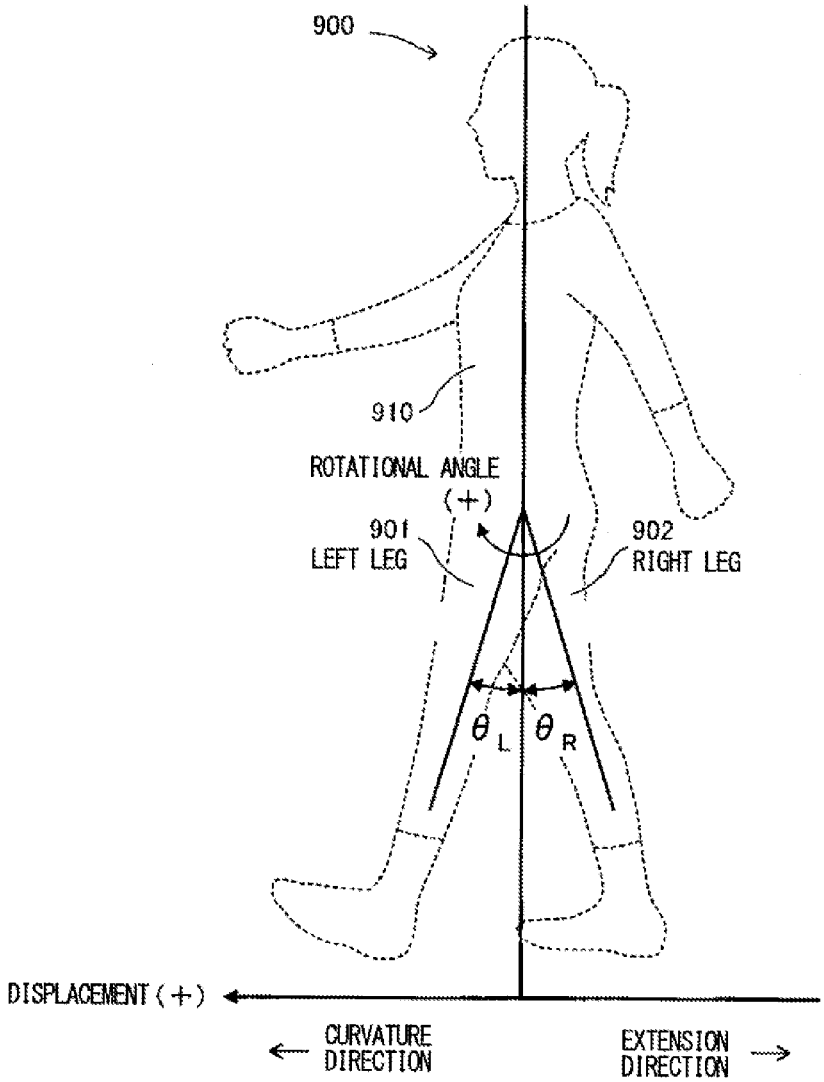
FIG. 3 is a view for describing the definition of the rotational angle and the movement of the user.

FIG. 3 is a view for describing the definition of the rotational angle and the movement of the user 900. As shown in the drawing, the direction of the displacement occurring when the user 900 progresses forward is set as the positive direction. During the swinging movement, the thighs are relatively close the upper body 910, and this is referred to as curvature movement. During curvature movement, the displacement direction is the positive direction. Furthermore, with a center line along the gravity direction of the upper body 910 serving as a base line, the line portion along a thigh and having a hip joint as one end forms a positive rotation angle relative to the base line. In the drawing, the left leg is in the midst of the swinging movement, and the left hip join angle $\theta_L$, which is the angle formed by the line portion along the left thigh 901 relative to the base line, has a positive value.

During the kicking movement, the thighs are relatively far from the upper body 910, and this is referred to as extension movement. During extension movement, the displacement direction is the negative direction. Furthermore, the line portion along the thigh with the hip joint as one end forms a negative rotational angle relative to the base line. In the drawing, the right leg is in the midst of the kicking movement, and the right hip join angle $\theta_R$, which is the angle formed by the line portion along the right thigh 902 relative to the base line, has a negative value.

Figure 4:
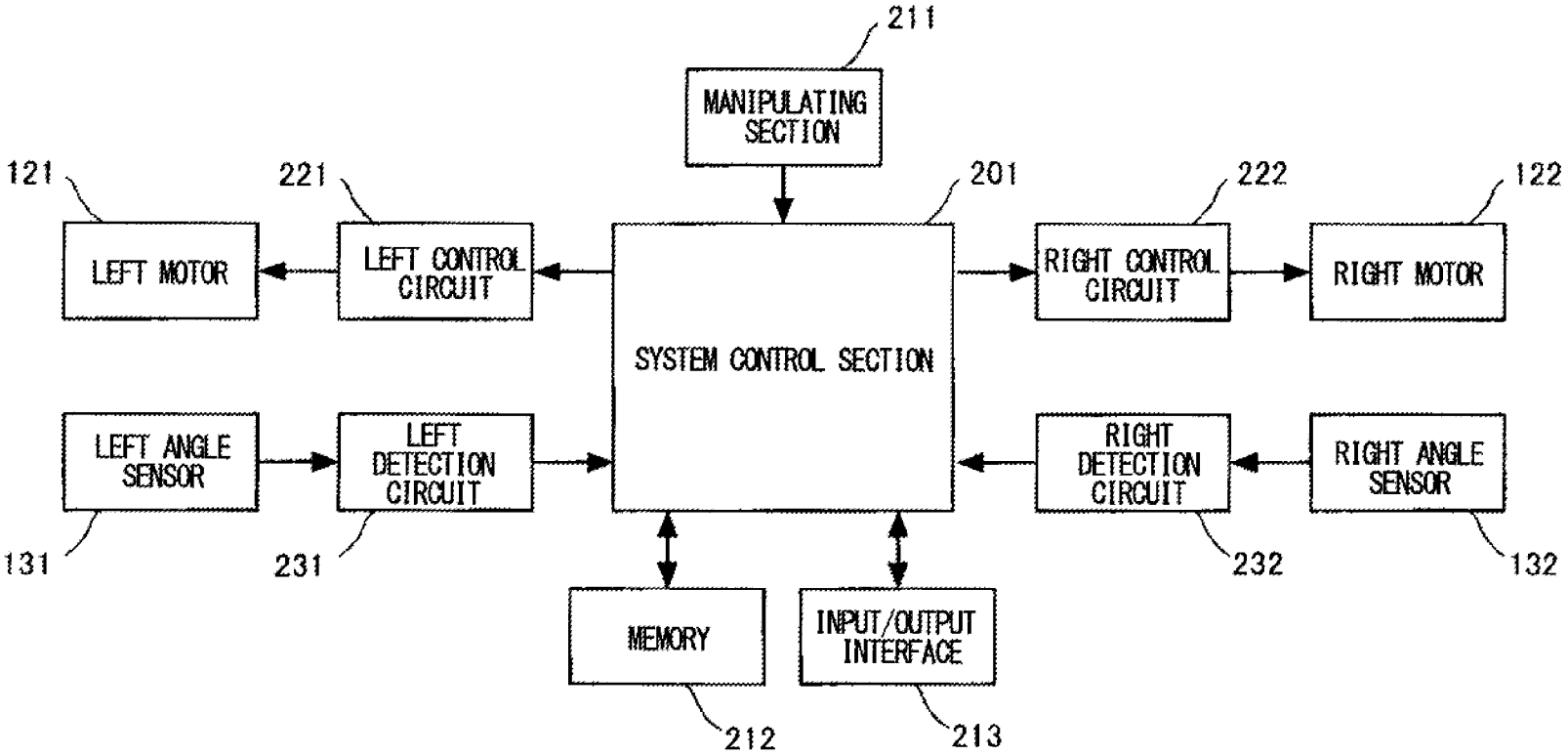
FIG. 4 is an element block diagram for describing each control element forming the step assist device.

The following describes each control element forming the step assist device 100. FIG. 4 is an element block diagram for describing each control element forming the step assist device 100. As shown in the drawing, each control element forming the step assist device 100 performs at least one of input and output either directly or indirectly with the system control section 201. In other words, the system control section 201 acting as a CPU that executes a preset program performs overall control of these control elements.

The system control section 201 controls the left motor 121 via a left control circuit 221. In the same manner, the system control section 201 controls the right motor 122 via a right control circuit 222. Specifically, after the auxiliary force for assisting the left leg is calculated, the system control section 201 provides the left control circuit 221 with calculation results at a timing for generating this assisting auxiliary force, and after the auxiliary force for assisting the right leg is calculated, the system control section 201 provides the right control circuit 222 with calculation results at a timing for generating this assisting auxiliary force. The left control circuit 221 and the right control circuit 222 each generate an analog drive voltage according to the provided calculation results, and respectively apply this drive voltage to the left motor 121 and the right motor 122. In other words, the left control circuit 221 and the right control circuit 222 have amplification circuits including DA converters.

The system control section 201 receives a detection result of the left angle sensor 131 via a left detection circuit 231. In the same manner, the system control section 201 receives a detection result of the right angle sensor 132 via a right detection circuit 232. Specifically, the left angle sensor 131 is made to continuously generate a voltage pulse according to the rotational angle of the left thigh 901. The left detection circuit 231 counts this voltage pulse to convert the voltage pulse into a rotation angle per unit time, and provides, per unit time, the system control section 201 with this rotational angle as a digital value. The system control section 201 can continuously be aware of the left hip angle $\theta_L$ shown in FIG. 3 by continuously calculating the rotational angle from an activation time and a reset time for each unit time. In the same manner, the right angle sensor 132 is made to continuously generate a voltage pulse according to the rotational angle of the right thigh 902. The right detection circuit 232 counts this voltage pulse to convert the voltage pulse into a rotation angle per unit time, and provides, per unit time, the system control section 201 with this rotational angle as a digital value. The system control section 201 can continuously be aware of the right hip angle $\theta_R$ shown in FIG. 3 by continuously calculating the rotational angle from an activation time and a reset time for each unit time. In the present embodiment, the step count for the left leg and the step count for the right leg in the stepping movement of the user 900 are calculated by adding together the left hip angles $\theta_L$ and the right hip angles $\theta_R$ obtained here.

The manipulating section 211 is a manipulation component for receiving instructions from the user 900, and includes the activation switch 101. In FIG. 2, the manipulating section 211 is represented by only the activation switch 101, but a manipulation component such as controls for receiving an auxiliary force adjustment may be included. The system control section 201 performs control according to changes in the manipulation component detected by the manipulating section 211.

The memory 212 is a storage apparatus using a flash memory, such as an SSD, and stores the programs executed by the system control section 201, various parameter values, and the like in a manner to not be lost when the power supply is turned off. The memory 212 also functions as a work memory that temporarily stores values generated by the calculations performed by the system control section 201. In the present embodiment, the step count for the left leg and the step count for the right leg of the user 900 during walking, which are calculated by the system control section 201, are stored. The memory 212 may be formed from a plurality of types of memories that are physically isolated, according to the use of each memory.

The input/output interface 213 includes a communicating section that performs input and output with an external device. For example, when the step assist device 100 is connected to a smart phone as the external device, the input/output interface 213 receives setting content set by a smartphone and transmits to the smartphone the step count data calculated by the system control section 201.

Figure 5:
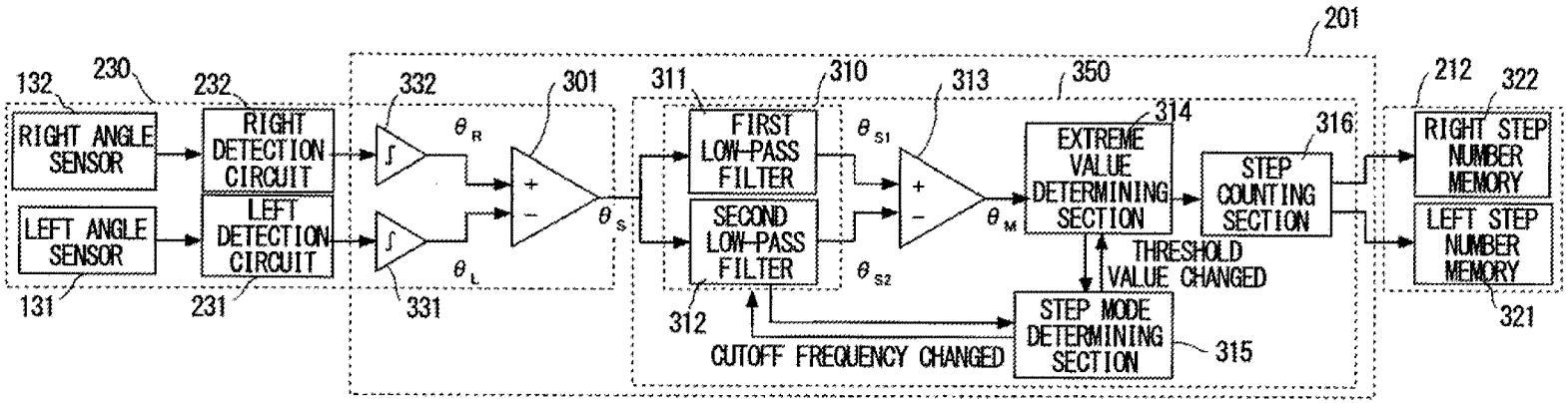
FIG. 5 is a function block diagram for describing the basic processes performed in the step count.

The following describes the step count according to the present embodiment. FIG. 5 is a function block diagram for describing the basic processes performed in the step count.

In the manner described above, the output signal that is output from the right angle sensor 132 is converted into a rotational angle of the right thigh 902 per unit time by the right detection circuit 232, and the resulting rotational angle is transmitted to the system control section 201. In the same manner, the output signal that is output from the left angle sensor 131 is converted into a rotational angle of the left thigh 901 per unit time by the left detection circuit 231, and the resulting rotational angle is transmitted to the system control section 201. The processes described below are performed by the system control section 201 on both of these signals, and the processes performed by the system control section 201 are described sequentially using function blocks.

The right integrator 332 continuously integrates the rotational signal received from the right detection circuit 232, from the activation time and from the reset time, and outputs the right hip joint angle $\theta_R$. In the same manner, the left integrator 331 continuously integrates the rotational signal received from the left detection circuit 231, from the activation time and from the reset time, and outputs the left hip joint angle $\theta_L$.

The first differential circuit 301 receives the right hip joint angle $\theta_R$ and the left hip joint angle $\theta_L$, which are output at the same time respectively from the right integrator 332 and the left integrator 331, and outputs a differential angle $\theta_S$ that is equal to $\theta_R-\theta_L$. In other words, the first differential circuit 301 continually outputs the angle difference between the right hip joint angle and the left hip joint angle. In this sense, the left angle sensor 131, the left detection circuit 231, the left integrator 331, the right angle sensor 132, the right detection circuit 232, the right integrator 332, and the first differential circuit 301 function as a detecting section 230 that detects the angle difference between the right hip joint angle and the left hip joint angle of the user 900.

The differential angle $\theta_S$ output from the first differential circuit 301 is branched into two signals and input to the first low-pass filter 311 and the second low-pass filter 312. The first low-pass filter 311 and the second low-pass filter 312 are digital low-pass filters with different cutoff frequencies, and together form the filter section 310. With the cutoff frequency of the first low-pass filter 311 represented as $\omega_H$ and the cutoff frequency of the second low-pass filter 312 represented as $\omega_L$, the relationship $\omega_H>\omega_L$ is established. The cutoff frequency during normal steps described below is such that $\omega_H$ is a value set in a range from 0.1 Hz to 10 Hz and $\omega_L$ is a value set in a range from 0.01 Hz to 1 Hz. Any type of low-pass filters can be used for the first low-pass filter 311 and the second low-pass filter 312, but since a difference between the outputs of these filters is to be calculated as described below, it is preferable that both of these low-pass filters be of the same type.

For example, when the digital low-pass filter used as the first low-pass filter 311 is a first-order low-pass filter, the transfer function $H_1(s)$ of this filter is expressed as shown in Expression 1.

$$H_1(s)=V_{OUT}/V_{IN}=k_1/(1+(s/\omega_H)) \quad \text{Expression 1:}$$

In the same manner, when the digital low-pass filter used as the second low-pass filter 312 is a first-order low-pass filter, the transfer function $H_2(s)$ of this filter is expressed as shown in Expression 2.

$$H_2(s)=V_{OUT}/V_{IN}=k_2/(1+(s/\omega_L)) \quad \text{Expression 2:}$$

Here, $k_1$ and $k_2$, which are the gain at the passed band, are preferably the same value, in consideration of the post-processing in which the difference between the outputs is calculated. Furthermore, it is acceptable that $k_1=k_2=1$.

The first low-pass filter 311 outputs a first filtered angle $\theta_{S1}$ as a filtered signal. The second low-pass filter 312 outputs a second filtered angle $\theta_{S2}$ as a filtered signal.

The second differential circuit 313 receives the first filtered angle $\theta_{S1}$ and the second filtered angle $\theta_{S2}$, which are output at the same time from the first low-pass filter 311 and the second low-pass filter 312, and outputs a corrected differential angle $\theta_M$ that is equal to $\theta_{S1}-\theta_{S2}$. In other words, the second differential circuit 313 continually outputs the reshaped angle difference between the hip joints. The specific manner in which the waveform is reshaped through this series of signal processing is described further below.

The extreme value determining section 314 receives the corrected differential angle $\theta_M$ and determines whether a target input value is an extreme value. Although described in greater detail further below, the basic process includes recognizing one step of the right leg when the input value is a positive extreme value (indicative of the $\theta_M$ waveform protruding upward) and recognizing one step of the left leg when the input value is a negative extreme value (indicative of the $\theta_M$ waveform protruding downward). The extreme value determining section 314 supplies the determination result to the step mode determining section 315 and the step counting section 316. Furthermore, the extreme value determining section 314 supplies the step mode determining section 315 with a period obtained as the time interval between extreme values.

The step mode determining section 315 determines a step mode by using the determination result and period received from the extreme value determining section 314 and the second filtered angle $\theta_{S2}$ received from the second low-pass filter 312. In the present embodiment, the step mode is determined to be normal steps, dragging step, or slow steps. The determination result is supplied to the filter section 310 and the extreme value determining section 314. The filter section 310 changes the cutoff frequencies of the first low-pass filter 311 and the second low-pass filter 312 according to the determination result from the step mode determining section 315. The extreme value determining section 314 changes threshold values that are parameters for determining the extreme values, according to the determination result from the step mode determining section 315. The details of this process are described further below.

The step counting section 316 identifies the step number for the left leg and the step number for the right leg in a series of stepping movements, by cumulatively counting the determination results from the extreme value determining section 314 continually received from the activation time and from the reset time. The first low-pass filter 311, the second low-pass filter 312, the second differential circuit 313, the extreme value determining section 314, the step mode determining section 315, and the step counting section 316, which are involved in the processes from receiving the differential angle $\theta_S$ to identifying the step number for the right leg and the step number for the left leg, function as a calculating section 350 that calculates the step number for the user 900.

The step counting section 316 stores the step number for the right leg in the right step number memory 322 as right leg step number data, and stores the step number for the left leg in the left step number memory 321 as left leg step number data. The right step number memory 322 and the left step number memory 321 make up a portion of the memory 212. The step counting section 316 may update the right leg step number data or the left leg step number data stored in the right step number memory 322 or the left step number memory 321 every time the identified step number is updated, or may update this data when the activation switch 101 is again pressed and the end instructions are received.

The following describes how the signal waveform is changed in each of the processes described above, and the technical significance of these changes. FIGS. 6A to 6F are views to describe the changes in the signal waveforms. In each of the drawings, the horizontal axis indicates the passage of time and the vertical axis indicates the angle.

Figure 6A:
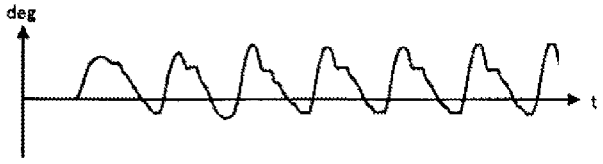
FIGS. 6A to 6F are views to describe the changes in the signal waveforms.
Figure 6B:
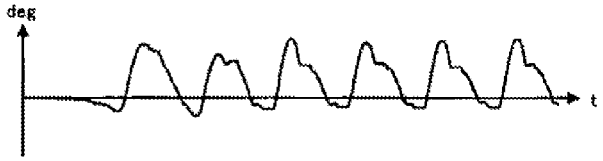
Figure 6C:
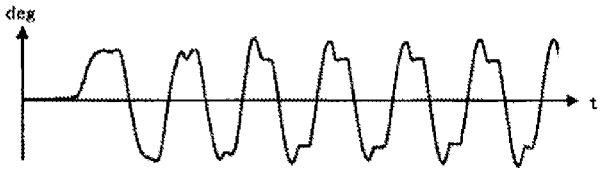

FIG. 6A shows an example of the right hip joint angle $\theta_R$ and FIG. 6B shows an example of the left hip joint angle $\theta_L$. In the present embodiment, the observation target for which the step count is performed is the differential angle that is the angle difference between the hip joints. If the angle difference causes a large physical displacement amount and a rotary encoder is used, which is a highly developed sensor, an output signal can be acquired that is much more stable than the output signal of an acceleration sensor. Furthermore, a step count application using an acceleration sensor loaded on a smartphone, for example, merely observes vibration occurring in three axial directions at the position where the smartphone is held by the user and sometimes acquires vibration that is not caused by the stepping movement, such that there is a large error in the number of steps counted. In addition, it is impossible to distinguish between the step number for the left leg and the step number for the right leg. In the present embodiment, by performing the filtering process while acquiring the stable output signal by setting the angle difference as the observation target, the step number for the right leg and the step number for the left leg can both be accurately identified.

The right hip joint angle $\theta_R$ and the left hip joint angle $\theta_L$ are extremely stable signals compared to the output signal of an acceleration sensor, but still include a small noise component and offset component. The differential angle $\theta_S$ shown in FIG. 6C has a waveform obtained by subtracting the left hip joint angle $\theta_L$ from the right hip joint angle $\theta_R$, and therefore still includes the noise component and the offset component.

Figure 6D:
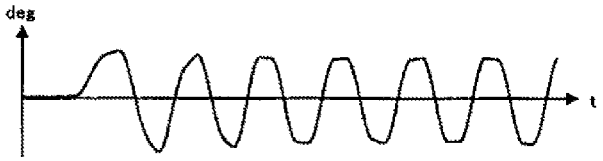

The waveform of the first filtered angle $\theta_{S1}$, which is obtained by applying the angle difference $\theta_S$ to the first low-pass filter with the cutoff frequency $\omega_H$ in order to remove the high frequency noise component from the angle difference $\theta_S$, is shown in FIG. 6D. As seen from the drawing, the small high frequency noise is removed, and a certain amount of amplitude is preserved. However, since the low frequency component is passed, the offset component remains.

Figure 6E:
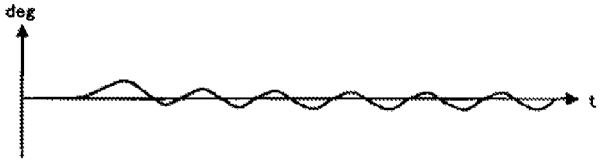

The waveform of the second filtered angle $\theta_{S2}$, which is obtained by applying the angle difference $\theta_S$ to the second low-pass filter with the cutoff frequency $\omega_L$ that is lower than the cutoff frequency $\omega_H$ in order to remove as much of the signal other than the offset component from the angle difference $\theta_S$, is shown in FIG. 6E. The high frequency component is further removed, and the amplitude is compressed in this waveform, such that almost none of the offset component remains.

Figure 6F:
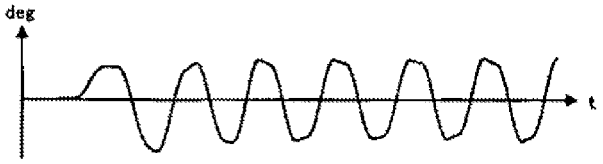

FIG. 6F shows the waveform of the corrected differential angle $\theta_M$, which is obtained by subtracting the second filtered angle $\theta_{S2}$ from the first filtered angle $\theta_{S1}$. The first filtered angle $\theta_{S1}$ and the second filtered angle $\theta_{S2}$ contain the same offset component, and therefore the offset components cancel out as a result of subtracting the second filtered angle $\theta_{S2}$ from the first filtered angle $\theta_{S1}$. Furthermore, both of these angles are signals that have passed through a low-pass filter, and therefore the noise components have been removed. In other words, the waveform of the corrected differential angle $\theta_M$ can be said to be a highly corrected waveform compared to the waveform of the differential angle $\theta_S$. With the waveform corrected in this manner, the extreme value determination process, the step mode determination process, and the like performed later can be performed with very high accuracy.

The dimension of the signal output through the processes described above is an "angle," and therefore in the present embodiment, the obtained waveform is treated as an angle, such as the "corrected differential angle." However, for the first filtered signal $\theta_{S1}$, the second filtered angle $\theta_{S2}$, and the corrected differential angle $\theta_M$ that have passed through the low-pass filters, the angle indicated by the absolute value of the amplitude changes according to the characteristics of the low-pass filters used. Accordingly, when the reshaped corrected differential angle $\theta_M$ is used in a determination process, this angle is used as a signal waveform, and is not used as angle information with an absolute value.

Figure 7A:
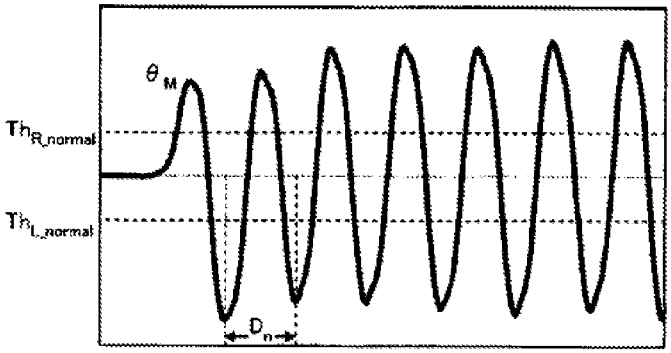
FIGS. 7A to 7C are views for describing detection signals for each type of representative step.
Figure 7B:
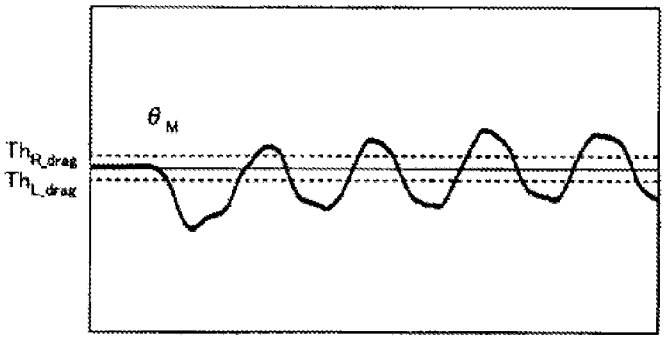
Figure 7B:
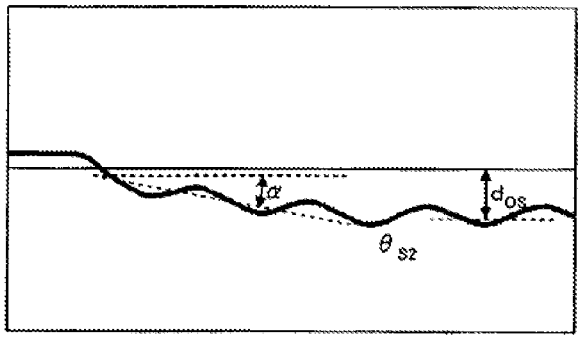
Figure 7C:
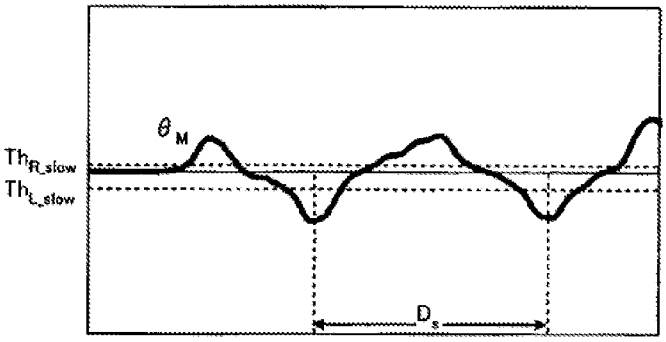

The following describes various types of representative steps. FIGS. 7A to 7C are views for describing detection signals for each type of representative step. The step mode determining section 315 determines these types of steps. Specifically, FIG. 7A shows a waveform of the corrected differential angle $\theta_M$ during normal steps, FIG. 7B shows a waveform of the corrected differential angle $\theta_M$ during dragging steps, FIG. 7B' shows a waveform of the second filtered angle $\theta_S$ during dragging steps, and FIG. 7C shows a waveform of the corrected differential angle $\theta_M$ during slow steps. In the same manner as in FIGS. 6A to 6F, the horizontal axes indicate the passage of time and the vertical axes indicate the angle. In each of the waveforms, a positive value indicates that the right hip joint angle $\theta_R$ is greater than the left hip joint angle $\theta_L$, which indicates a state in which the right leg is ahead of the left leg. In particular, an increasing slope in the waveform indicates a state in which the right leg is swinging forward, there is a peak value (positive extreme value) approximately when the right foot reaches the floor, and then there is a decreasing slope indicating that the left leg is following the right leg. This series of leg movements is one step of the right leg. On the other hand, a negative value indicates that the left hip joint angle $\theta_L$ is greater than the right hip joint angle $\theta_R$, which indicates a state in which the left leg is ahead of the right leg. In particular, a decreasing slope in the waveform indicates a state in which the left leg is swinging forward, there is a peak value (negative extreme value) approximately when the left foot reaches the floor, and then there is an increasing slope indicating that the right leg is following the left leg. This series of leg movements is one step of the left leg.

The waveform of the normal steps shown in FIG. 7A is an example of the waveform (corrected differential angle $\theta_M$) obtained when a healthy person walks at a speed of 3.6 km/h. For the corrected differential angle $\theta_M$ of normal steps, the system control section 201 sets a positive threshold value $Th_{R_normal}$ and a negative threshold value $Th_{L_normal}$. The extreme value determining section 314 determines that there has been one step of the right leg when $\theta_M$ exceeds $Th_{R_normal}$, i.e. goes above $Th_{R_normal}$, to form a peak protruding upward. In a similar manner, the extreme value determining section 314 determines that there has been one step of the left leg when $\theta_M$ exceeds $Th_{L_normal}$, i.e. goes below $Th_{L_normal}$, to form a peak protruding downward. In other words, no steps are determined even when there is a peak within a range between $Th_{R_normal}$ and $Th_{L_normal}$. By including this dead zone, it is possible to avoid errors in determination even when a leg is moved suddenly for a reason other than stepping, for example.

The waveform of the dragging steps shown in FIG. 7B is an example of the waveform (corrected differential angle $\theta_M$) obtained when a rehabilitation patient walks while dragging his/her right leg. In the case of dragging steps, the differential angle $\theta_S$ is smaller than in the case of normal steps, by the amount that the hip joint angle for the leg being dragged is smaller. Furthermore, the waveform is affected by the change in the cutoff frequency applied when dragging steps are determined, such that the amplitude of the corrected differential angle $\theta_M$ is smaller than in the case of normal steps. For the corrected differential angle $\theta_M$ of this type of dragging steps, the system control section 201 sets a positive threshold value $Th_{R_drag}$ and a negative threshold value $Th_{L_drag}$, in a manner such that $Th_{R_drag}<Th_{R_normal}$ and $Th_{L_drag}>Th_{L_normal}$. Obviously the system control section 201 may use values for $Th_{R_drag}$ and $Th_{L_drag}$ when it is determined that the right leg is dragging that are different from the values for $Th_{R_drag}$ and $Th_{L_drag}$ when it is determined that the left leg is dragging.

The threshold value $Th_{R_drag}$ and the threshold value $Th_{L_drag}$ may be fixed values that are preset for dragging steps, or may be changed dynamically according to the waveform of the obtained corrected differential angle $\theta_M$. When dynamically changing these values, the change can be performed according to the difference between the positive and negative peak values, for example. Specifically, a predetermined fixed value can be added to an intermediate value calculated from the average value of three continuous positive extreme values and the average value of three continuous negative extreme values to obtain the threshold value $Th_{R_drag}$, and this predetermined fixed value can be subtracted from this intermediate value to obtain the threshold value $Th_{L_drag}$.

The step number determination is the same as the determination method used for the normal steps. In other words, the extreme value determining section 314 determines that there has been one step of the right leg when $\theta_M$ exceeds $Th_{R_drag}$ to form a peak protruding upward. In a similar manner, the extreme value determining section 314 determines that there has been one step of the left leg when $\theta_M$ exceeds $Th_{L_drag}$ to form a peak protruding downward.

In this way, if calculated from the angle difference of the hip joint angles, the step number can be accurately identified even on the side of the leg that is dragging. On the other hand, with a step counter that detects contact between the sole of the foot and the ground, it is impossible to identify the step count of the foot that is dragging.

As shown in FIG. 7B, the corrected differential angle $\theta_M$ in which the offset components have been cancelled out exhibits a symmetric waveform with respect to amplitude zero, even when the right leg is dragging. Accordingly, is it difficult to distinguish between normal steps and dragging steps based only on the amplitude difference. On the other hand, in the waveform obtained immediately after being passed through the low-pass filter, the characteristics of the dragging steps are relatively prominent. The waveform for the dragging steps shown in FIG. 7B' is an example of the waveform after having passed through the second low-pass filter 312, i.e. the second filtered angle $\theta_{S2}$, which is obtained when a rehabilitation patient steps while dragging their right foot. As seen from the drawing, $\theta_{S2}$ has a waveform that exhibits a mild slope in the negative direction during the initial stage of the steps, and then moves with a fixed offset toward the negative side of amplitude zero from the horizontal axis. Although not shown in the drawings, when the left leg is dragging, $\theta_{S2}$ has a waveform that exhibits a mild slope in the positive direction during the initial stage of the steps, and then moves with a fixed offset toward the positive side of amplitude zero from the horizontal axis.

Accordingly, the system control section 201 fits a straight line to the waveform of several steps at the initial stage of the steps, and if the resulting angle $\alpha$ is greater than a threshold value $\alpha_0$ that is set in advance from experimental results, for example, the system control section 201 can determine there to be dragging steps. In particular, the system control section 201 can determine that the right leg is dragging if the fitted straight line has a negative slope, and can determine that the left leg is dragging if the fitted straight line has a positive slope. At a point after the initial stage of the stepping, the system control section 201 fits a straight line to the waveform of several steps and can determine that there are dragging steps if the offset amount $d_{OS}$ is greater than a threshold value $d_0$ that is set in advance from experimental results, for example. In particular, the system control section 201 can determine that the right leg is dragging if the fitted straight line is offset to the negative side, and can determine that the left leg is dragging if the fitted straight line is offset to the positive side.

In the present embodiment, the cutoff frequency $\omega_H$ of the first low-pass filter 311 and the cutoff frequency $\omega_L$ of the second low-pass filter 312 have the relationship of $\omega_H > \omega_L$, and therefore the waveform that has passed through the second low-pass filter 312, i.e. the second filtered angle $\theta_{S2}$, in which the low frequency component is flatter is preferably used for the dragging steps determination. However, if at least one of the threshold value $\alpha_0$ and the offset amount $d_{OS}$ described above can be calculated with a certain degree of accuracy, the waveform that has passed through the first low-pass filter 311, i.e. the first filtered angle $\theta_{S1}$, may be used. As another example, instead of the first low-pass filter 311 or the second low-pass filter 312, another low-pass filter with a different cutoff frequency may be used for the dragging steps determination.

The waveform of the slow steps shown in FIG. 7C is an example of the waveform (corrected differential angle $\theta_M$) obtained when a person walks at a speed of 0.6 km/h. The amplitude in the positive direction representing the gait of the right leg and the amplitude in the negative direction representing the gait of the left leg are both smaller than in the example of FIG. 7A. Furthermore, $D_S$ representing the period of one step is considerably greater than $D_n$, which is the period during the normal steps. This indicates that each step movement requires more time, and that the both legs have a smaller swinging angle, which causes the span of each step to be smaller. For the corrected differential angle $\theta_M$ of this type of slow steps, the system control section 201 sets a positive threshold value $Th_{R_slow}$ and a negative threshold value $Th_{L_slow}$. Specifically, these values are set such that $Th_{R_normal} > Th_{R_slow}$ and $Th_{L_normal} < Th_{L_slow}$.

The threshold value $Th_{R_slow}$ and the threshold value $Th_{L_slow}$ may be fixed values that are preset for slow steps, or may be changed dynamically according to the waveform of the obtained corrected differential angle $\theta_M$. In particular, there is a tendency for left-right symmetry of the gait to be lost in the case of slow steps, and therefore the threshold values are preferably set according to the waveform. In the case of slow steps as well, the threshold values can be changed according to the difference between the positive and negative peaks, using the same method as described in the case of dragging steps.

Figure 8:
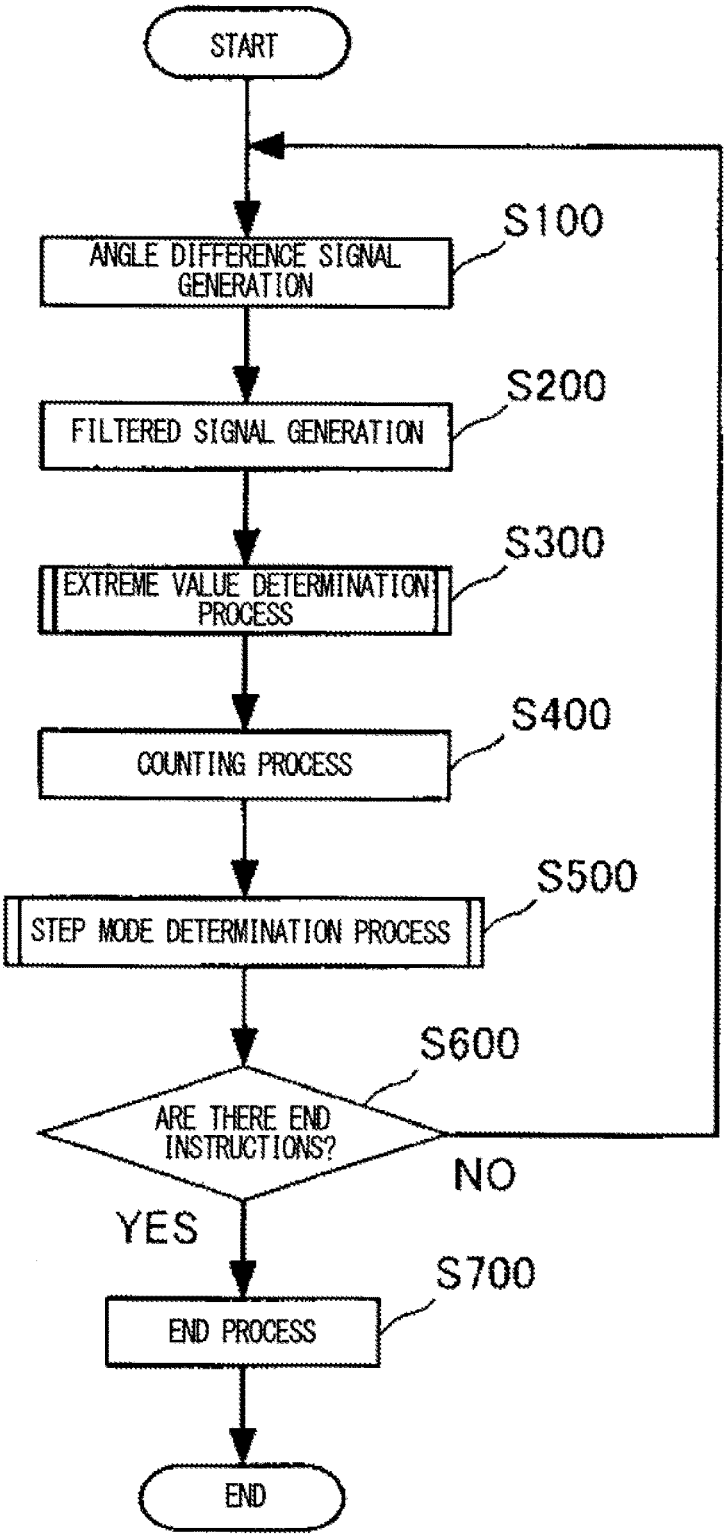
FIG. 8 is a flow chart showing the overall flow of the step counting process.

The following describes the control performed by the system control section 201, as a series of processes. FIG. 8 is a flow chart showing the overall flow of the step counting process. The flow begins when the system control section 201 has finished the initialization operation, after the activation switch 101 is pressed by the user 900 and the system control section 201 begins reading the control program from the memory 212.

At step S100, the system control section 201 causes the detecting section 230 to function to acquire the right hip joint angle $\theta_R$ and the left hip joint angle $\theta_L$, thereby generating the differential angle $\theta_S$ that is the angle difference signal for the difference between the hip joints using the first differential circuit 301. The process proceeds to step S200, where the generated differential angle $\theta_S$ is input to the filter section 310 to generate the first filtered angle $\theta_{S1}$ and the second filtered angle $\theta_{S2}$. Furthermore, the second differential circuit 313 is used to generate the corrected differential angle $\theta_M$, as the filtered signal obtained as the difference between the filtered angles.

The system control section 201 proceeds to step S300 and uses the extreme value determining section 314 to perform the extreme value determination process, using the corrected differential angle $\theta_M$ generated by the second differential circuit 313. The extreme value determination process is a process that includes determining the extreme value that is the target of the step count, and calculating the period of the steps using the determined extreme values. The details of this process are described further below. The determination results obtained through the extreme value determination process are carried to step S400, where the system control section 201 uses the step counting section 316 to perform a count process that updates the step number of the right leg and the step number of the left leg.

Furthermore, the determination results and the period acquired through the extreme value determination are carried to step S500, where the system control section 201 uses the step mode determining section 315 to perform the step mode determination process. The step mode determination process includes determining whether the steps taken by the user 900 are normal steps, dragging steps, or slow steps, and changing each type of parameter according to the determination results. The details of this process are described further below. The order in which step S400 and step S500 are performed may be reversed.

The system control section 201 proceeds to step S600 and determines whether end instructions have been received from the user 900. Specifically, the system control section 201 detects whether the activation switch 101 has been pressed again. The subject performing the pressing operation is not limited to the user 900, and may be an assistant or the like.

If it is determined at step S600 that end instructions have not yet been received, the system control section 201 returns to step S100 and repeats the series of processes. If it is determined that end instructions have been received, the process moves to step S700.

The system control section 201 performs the end process at step S700. Specifically, the system control section 201 stores the step number for the left leg and the step number for the right leg that have been cumulatively counted by the step counting section 316 in the left step number memory 321 and the right step number memory 322, respectively, as the step number data. Furthermore, the step number data is transmitted to an external device through the input/output interface 213. A general user, including the user 900, can identify the right leg step number and the left leg step number by using a smartphone as the external device, for example. By making a request from the external device, the general user can read the step number data from the right step number memory 322 and the left step number memory 321 to the external device at a desired timing, through the input/output interface 213.

The system control section 201 ends the series of processes when the end process is completed, and stops the supply of power from the battery 102.

Figure 9:
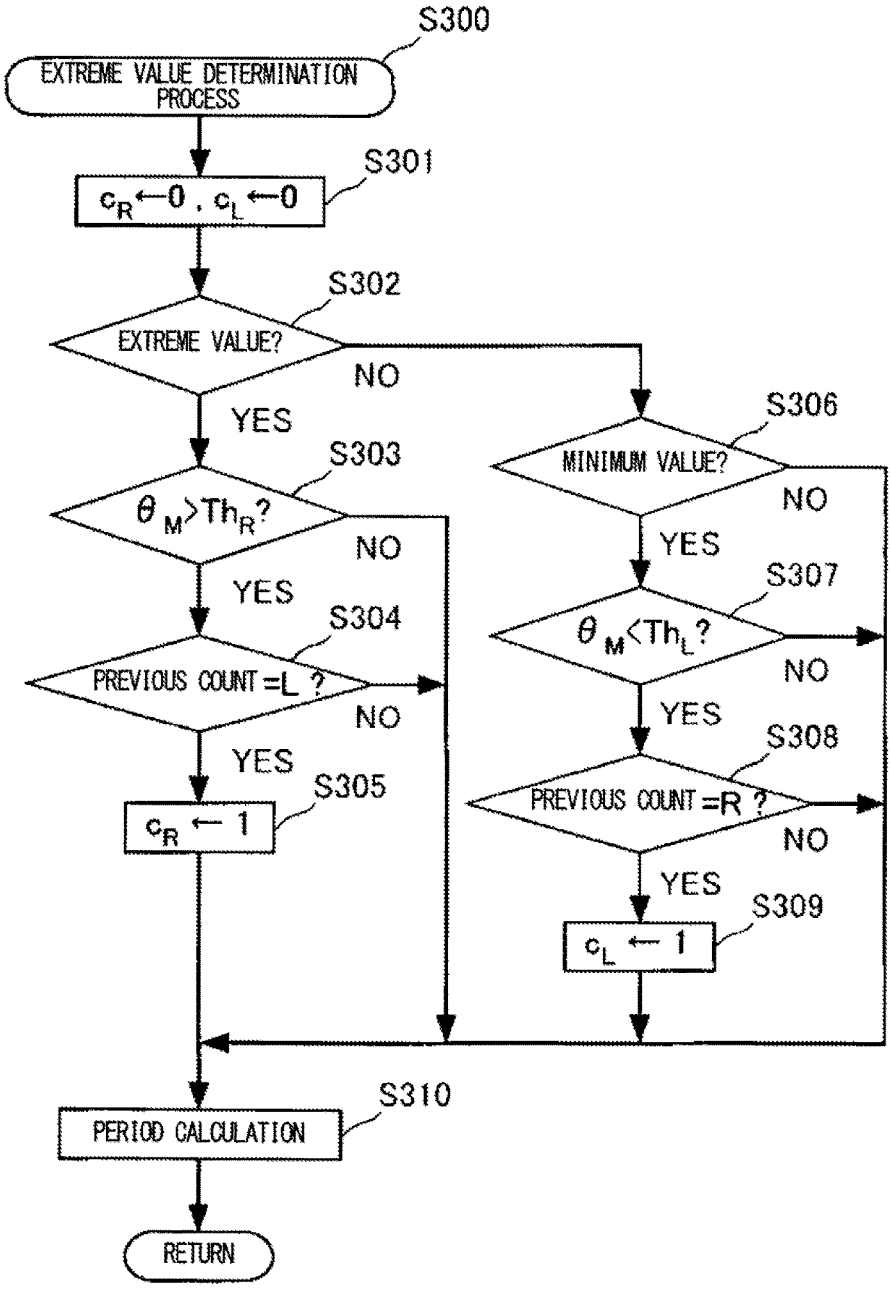
FIG. 9 is a sub-flow chart showing the details of the extreme value determination process.

FIG. 9 is a sub-flow chart showing the details of the extreme value determination process performed at step S300. As described above, the extreme value determination process is performed by the extreme value determining section 314, serving as a function block of the system control section 201.

At step S301, the extreme value determining section 314 performs initialization by substituting a value of 0 for each of $c_R$, which is a flag variable for the right leg, and $c_L$, which is a flag variable for the left leg. The process then moves to step S302, where the extreme value determining section 314 determines whether the input corrected differential angle $\theta_M$ is a maximum value. There are many methods known for determining a maximum value, and as an example, the extreme value determining section 314 determines whether the $\theta_M$ value that is a determination target is a peak protruding upward, based on this $\theta_M$ value that is the determination target and the values at previous and following points. In this case, the extreme value determining section 314 acquires and temporarily holds the $\theta_M$ value that is the determination target and the $\theta_M$ values at several continuous previous and following points, and uses these for the determination.

If the $\theta_M$ value that is the determination target is determined at step S302 to be a maximum value, this $\theta_M$ value and the period D, which is the difference between the time at which this $\theta_M$ value was acquired and the time at which the previous $\theta_M$ value that is a maximum value was acquired, are supplied to the step mode determining section 315. The extreme value determining section 314 proceeds to step S303, and determines whether this $\theta_M$ value is greater than the positive threshold value $Th_R$. If the $\theta_M$ value is not greater than the threshold value $Th_R$, this means that this $\theta_M$ value is a maximum value that is within the dead zone, and therefore the process returns to the main flow without performing any additional steps. If the $\theta_M$ value is greater than the threshold value $Th_R$, the process moves to step S304.

At step S304, the extreme value determining section 314 checks whether the previous step count was for the left leg. The determination relating to the maximum value is a determination as to whether the step count was for the right leg, and therefore if the previous step count was for the left leg, the extreme value determining section 314 can determine that the current maximum value is one correct step of the right leg. On the other hand, if the previous step count was not for the left leg, i.e. if the previous step count was for the right leg, then the extreme value determining section 314 can assume this to be the result of picking up a vibration during the swinging movement, for example, and determines that this is not a step of the right leg. Accordingly, if the extreme value determining section 314 determines that the previous step count is not for the left leg, the process returns to the main flow without any additional steps being performed. If it is determined that the previous step count was for the left leg, the process moves to step S305. At step S305, the extreme value determining section 314 substitutes a value of 1 for $c_R$, and returns to the main flow.

If it is determined at step S302 that the $\theta_M$ value that is the determination target is not a maximum value, the extreme value determining section 314 moves to step S306 and determines whether the $\theta_M$ value that is the determination target is a minimum value. The method for determining a minimum value is similar to the method for determining a maximum value, and as an example, the extreme value determining section 314 determines whether the $\theta_M$ value that is a determination target is a peak protruding downward, based on this $\theta_M$ value that is the determination target and the values at previous and following points.

If the $\theta_M$ value that is the determination target is determined at step S306 to be a minimum value, this $\theta_M$ value and the period D, which is the difference between the time at which this $\theta_M$ value was acquired and the time at which the previous $\theta_M$ value that is a minimum value was acquired, are supplied to the step mode determining section 315. The extreme value determining section 314 proceeds to step S307, and determines whether this $\theta_M$ value is less than the negative threshold value $Th_L$. If the $\theta_M$ value is less than the threshold value $Th_L$, the process moves to step S308.

At step S308, the extreme value determining section 314 checks whether the previous step count was for the right leg. The determination relating to the minimum value is a determination as to whether the step count was for the left leg, and therefore if the previous step count was for the right leg, the extreme value determining section 314 can determine that the current minimum value is one correct step of the left leg. On the other hand, if the previous step count was not for the right leg, i.e. if the previous step count was for the left leg, then the extreme value determining section 314 determines that this is not a step of the left leg. If it is determined that the previous step count was for the right leg, the process moves to step S309. At step S309, the extreme value determining section 314 substitutes a value of 1 for $c_L$, and returns to the main flow.

If the extreme value determining section 314 determines at step S306 that the $\theta_M$ value is not a minimum value, determines at step S307 that the $\theta_M$ value is not less than the threshold value ThL, or determines at step S308 that the previous step count is not for the right leg, the process returns to the main flow without any additional steps being performed.

In the counting process of step S400, the step counting section 316 acquires the values of $c_R$ and $c_L$, increments the right leg step number if $c_R$ is 1, and increments the left leg step number if $c_L$ is 1.

Figure 10:
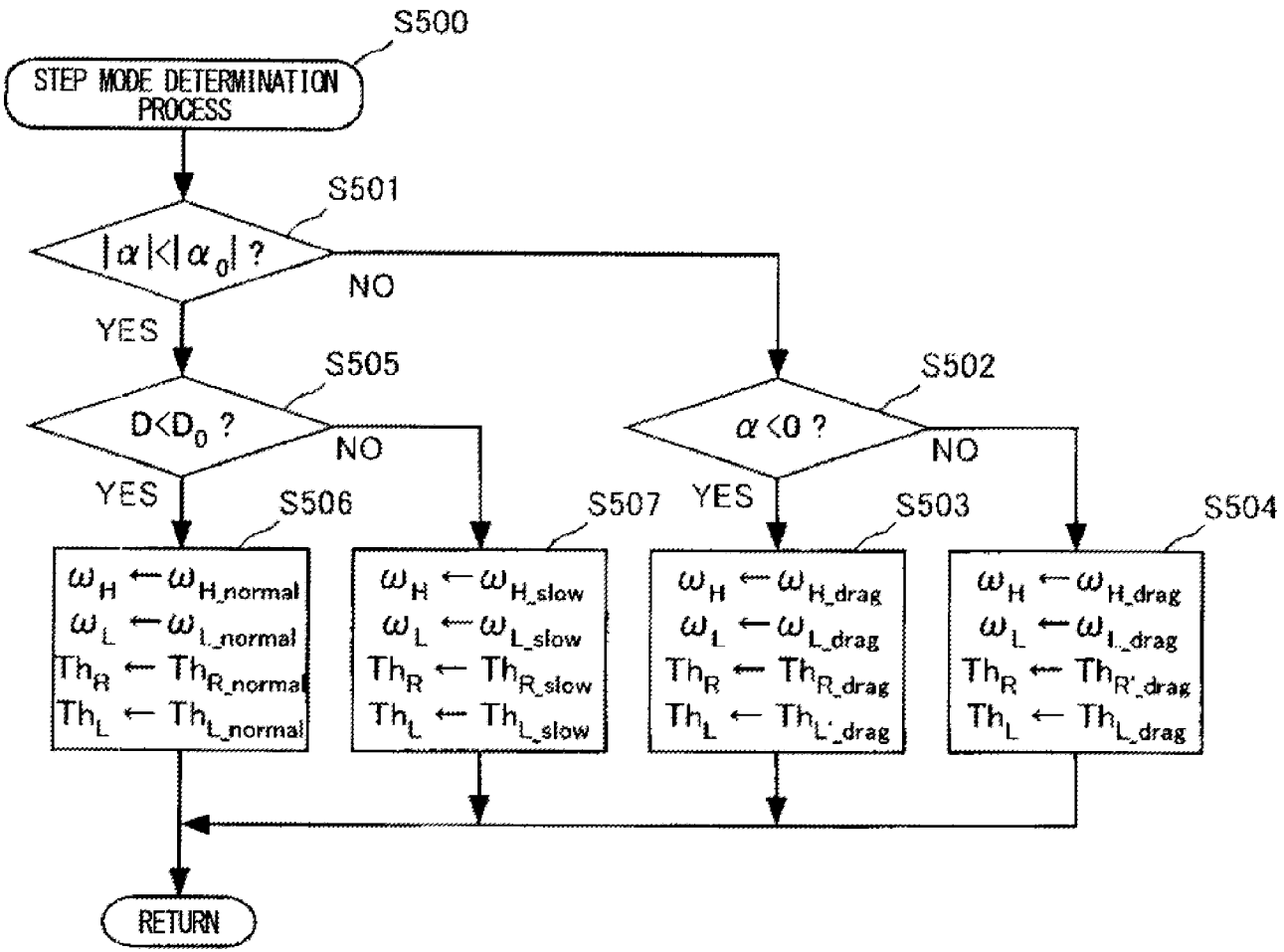
FIG. 10 is a sub-flow chart showing the details of the step mode determination process.

FIG. 10 is a sub-flow chart showing the details of the step mode determination process of step S500. As described above, the step mode determination process is performed by the step mode determining section 315, serving as a function block of the system control section 201.

At step S501, the step mode determining section 315 analyzes the angle $\theta_{S2}$ received from the second low-pass filter 312, and determines whether the absolute value of the angle $\alpha$ formed by the fitted straight line is less than the absolute value of the threshold value $\alpha_0$. If the absolute value of the angle $\alpha$ is less than the absolute value of the threshold value $\alpha_0$, it is determined that the steps are not dragging steps and the process moves to step S505, and if the absolute value of the angle $\alpha$ is not less than the absolute value of the threshold value $\alpha_0$, it is determined that the steps are dragging steps and the process moves to step S502. In this sub-flow, the dragging steps determination is made using the angle $\alpha$ formed by the fitted straight line, but as described above, the determination may instead be made using the offset amount $d_{OS}$ of the fitted line.

At step S502, the step mode determining section 315 determines whether $\alpha$ is less than 0. If it is determined that $\alpha$ is less than 0, the step mode determining section 315 determines that the right leg is dragging and moves to step S503, and if it is determined that $\alpha$ is not less than 0, the step mode determining section 315 determines that the left leg is dragging and moves to step S504.

At step S503, the step mode determining section 315 changes each type of parameter to a value suitable for dragging steps in which the right leg drags. Specifically, the step mode determining section 315 changes the cutoff frequency $\omega_H$ of the first low-pass filter 311, the cutoff frequency $\omega_L$ of the second low-pass filter 312, the positive threshold value $Th_R$, and the negative threshold value $Th_L$ to respectively be the values $\omega_{H_drag}$, $\omega_{L_drag}$, $Th_{R_drag}$, and $Th_{L'_drag}$ used for right-leg dragging steps. Although the right leg is dragging, as described above, the right and left processes are both affected in the filter process, and therefore $Th_L$ is also changed to a suitable value of $Th_{L'_drag}$. When the changing of the parameters is completed, the process returns to the main flow.

At step S504, the step mode determining section 315 changes each type of parameter to a value suitable for dragging steps in which the left leg drags. Specifically, the step mode determining section 315 changes the cutoff frequency $\omega_H$ of the first low-pass filter 311, the cutoff frequency $\omega_L$ of the second low-pass filter 312, the positive threshold value $Th_R$, and the negative threshold value $Th_L$ to respectively be the values $\omega_{H_drag}$, $\omega_{L_drag}$, $Th_{R'_drag}$, and $T_{L_drag}$ used for right-leg dragging steps. Although the left leg is dragging, as described above, the right and left processes are both affected in the filter process, and therefore $Th_R$ is also changed to a suitable value of $Th_{R'_drag}$. The same cutoff frequencies of $\omega_{H_drag}$ and $\omega_{L_drag}$ may be used in both a case where the left leg is dragging and a case where the right leg is dragging. When the changing of the parameters is completed, the process returns to the main flow.

At step S505, the step mode determining section 315 determines whether the period D received from the extreme value determining section 314 is less than the predetermined $D_0$. If D is less than $D_0$, the step mode determining section 315 determines that the steps are normal steps and moves to step S506.

At step S506, the step mode determining section 315 changes each type of parameter to a value suitable for normal steps. Specifically, the step mode determining section 315 changes the cutoff frequency $\omega_H$ of the first low-pass filter 311, the cutoff frequency $\omega_L$ of the second low-pass filter 312, the positive threshold value $Th_R$, and the negative threshold value $Th_L$ to respectively be the values $W_{H_normal}$, $\omega_{L_normal}$, $Th_{R_normal}$, and $Th_{L_normal}$ used for normal steps. When the changing of the parameters is completed, the process returns to the main flow.

If it is determined at step S505 that the period D is not less than $D_0$, the step mode determining section 315 determines that the steps are slow steps and moves to step S507.

At step S507, the step mode determining section 315 changes each type of parameter to a value suitable for slow steps. Specifically, the step mode determining section 315 changes the cutoff frequency $\omega_H$ of the first low-pass filter 311, the cutoff frequency $\omega_L$ of the second low-pass filter 312, the positive threshold value $Th_R$, and the negative threshold value $Th_L$ to respectively be the values $\omega_{H_slow}$, $W_{L_slow}$, $Th_{R_slow}$, and $Th_{L_slow}$ used for slow steps. When the changing of the parameters is completed, the process returns to the main flow.

The present embodiment is described above, but the function blocks and processing steps can be changed or removed as desired, depending on the configuration of the step assist device 100. For example, if it is assumed that the step assist device 100 will be used by a healthy person, the step mode determining section 315 may be removed from the calculating section 350 and the processes relating to the step mode determining section 315 may be omitted. In the present embodiment, the left angle sensor 131 and the right angle sensor 132 are arranged on each side of the waist region, but one angle sensor can be provided that outputs the angle difference between the hip joints inside the hip. In this case, the differential angle $\theta_S$ can be obtained directly through a single detection circuit.

In the present embodiment, two low-pass filters with different cutoff frequencies are used, but as long as the reshaped corrected differential angle $\theta_M$ is obtained, other filters may be used. For example, the two filters may each be formed of a low-pass filter and a high-pass filter, or may be condensed in a single band-pass filter.

The step pattern determination is not limited to normal steps, dragging steps, and slow steps, and the present invention may be configured to determine other step patterns. In this case, a step is added for identifying the step pattern of a characteristic gait of a rehabilitation patient. In the embodiment described above, the step count was performed for one step of the right leg and one step of the left leg, without distinguishing between the normal steps, slow steps, right-leg dragging steps, and left-leg dragging steps. However, a step data structure may be adopted that independently holds a step count for each step pattern, by internally interpreting the overall step count or separating other steps from the normal steps.

The input/output interface 213 may be configured to output data other than the step number data. For example, if the input/output interface 213 is configured to output the differential angle $\theta_S$ sequentially to an external device, the step counting can be performed by the external device. If the input/output interface 213 is configured to output a data sequence of the corrected differential angle $\theta_M$ to the external device, it is possible to utilize this data as history information for observing the rehabilitation process, for example.

In the present embodiment, the target apparatus is the step assist device 100, but the mechanism that generates auxiliary power for the steps of the user 900 may be removed, so that the present invention is configured as a step counter specialized for the function of counting the number of steps of the user 900. Furthermore, the step counter that performs the step count described in the present embodiment may be configured for use by being attached to a step assist device that generates an auxiliary force for stepping. Yet further, this type of step counter can be used in combination with an input device such as a motion capture apparatus.

The counted step number data can also be applied to auxiliary force control for the augmentation of kicking or swinging by the step assist device 100. For example, if the auxiliary force is increased as the number of steps increases, assistance can be provided in accordance with how tired the user 900 is. If the step count continues to be accumulated without being reset when the power supply is turned off, the auxiliary force can be changed according to the stage in the training of a rehabilitation patient. For example, in the initial stage, i.e. a stage in which a small number of steps are accumulated, the auxiliary force is strong, but as the patient progresses through the stages, i.e. every time the number of accumulated steps increases, the auxiliary power is controlled to become weaker. Furthermore, control may be performed to change the auxiliary force for the number of steps of each leg, according to the recovery rate for each of the left and right legs.

While the embodiments of the present invention have been described, the technical scope of the invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

LIST OF REFERENCE NUMERALS

100: step assist device, 101: activation switch, 102: battery, 103: waist frame, 104: waist belt, 121: left motor, 122: right motor, 131: left angle sensor, 132: right angle sensor, 141: left thigh frame, 142: right thigh frame, 151: left thigh belt, 152: right thigh belt, 201: system control section, 211: manipulating section, 212: memory, 213: input/output interface, 221: left control circuit, 222: right control circuit, 230: detecting section, 231: left detection circuit, 232: right detection circuit, 301: first differential circuit, 310: filter section, 311: first low-pass filter. 312: second low-pass filter. 313: second differential circuit, 314: extreme value determining section, 315: step mode determining section, 316: step counting section, 321: left step number memory, 322: right step number memory, 331: left integrator, 332: right integrator, 350: calculating section, 900: user, 901: left thigh, 902: right thigh, 910: upper body

What is claimed is:

1. A step assist device comprising:

a step counter including:

a right angle sensor that outputs a right hip joint angle signal indicating a right hip joint angle of a user;

a left angle sensor that outputs a left hip joint angle signal indicating a left hip joint angle of the user;

a generating section that generates an angle difference signal indicating change over time of an angle difference between the right hip joint angle and the left hip joint angle, based on the right hip joint angle signal and the left hip joint angle signal; and a calculating section that calculates a step number of the user based on a difference signal generated from a difference between filtered signals resulting from the angle difference signal being applied to at least two different filters, and a providing section that provides auxiliary force to a step movement of the user based on the calculated step number of the user.

2. The step assist device according to claim 1, wherein the filters are two low-pass filters having different cutoff frequencies.

3. The step assist device according to claim 1, wherein the calculating section changes cutoff frequencies of the filters based on the angle difference signal.

4. The step assist device according to claim 3, wherein the calculating section includes a determining section that, by processing the angle difference signal, determines at least one of dragging steps in which one of a right leg and a left leg is dragging and slow steps in which a period of a step is less than or equal to a predetermined period, and the calculating section changes the cutoff frequencies based on determination results of the determining section.

5. The step assist device according to claim 1, wherein the calculating section calculates the step number by counting the number of peaks that exceed a predetermined threshold value in the difference signal.

6. The step assist device according to claim 5, wherein the calculating section changes the threshold value based on the difference signal.

7. The step assist device according to claim 6, wherein the calculating section changes the threshold value based on a difference between positive and negative peaks in the difference signal.

8. The step assist device according to claim 6, wherein the calculating section includes a determining section that, by processing the angle difference signal, determines at least one of dragging steps in which one of a right leg and a left leg is dragging and slow steps in which a period of a step is less than or equal to a predetermined period, and the calculating section changes the threshold value based on determination results of the determining section.

9. The step assist device according to claim 1, wherein the calculating section calculates the step number while distinguishing between at least one of dragging steps in which one of a right leg and a left leg is dragging and slow steps in which a period of a step is less than or equal to a predetermined period.

10. The step assist device according to claim 9, wherein the calculating section determines the dragging steps based on at least one of a slope and an offset of a filtered signal obtained by applying the angle difference signal to a low-pass filter relative to a straight line of amplitude zero.

11. The step assist device according to claim 1, wherein the calculating section calculates the step number while distinguishing between a step number of a left leg and a step number of a right leg of the user.

12. The step assist device according to claim 11, wherein when steps of the same leg are consecutive, the calculating section counts the consecutive steps as a single step.

13. A non-transitory computer-readable medium storing thereon a program that, when executed by a computer, causes the computer to:

generate an angle difference signal indicating change over time of an angle difference between a right hip joint angle and a left hip joint angle, based on a right hip joint angle signal indicating the right hip joint angle of a user and output by a right angle sensor and a left hip joint angle signal indicating the left hip joint angle of the user and output by a left angle sensor;

calculate a step number of the user based on a difference signal generated from a difference between filtered signals resulting from the angle difference signal being applied to at least two different filters; and provide auxiliary force to a step movement of the user based on the calculated step number of the user.

* * * * *